US005280898A

United States Patent [19]

Nakano et al.

[11] Patent Number: 5,280,898

[45] Date of Patent: Jan. 25, 1994

[54] IMAGE FORMING APPARATUS HAVING A FRONT LOADING PAPER FEEDING MEMBER WITH AN IMPROVED PAPER JAM REMOVING MECHANISM

[75] Inventors: Kuniaki Nakano, Nara; Tadashi Fujioka, Toyonaka; Mitsuo Nomura, Kanazawa; Noriyuki Niino, Kobe; Masahiro Sako, Hirakata, all of Japan

[73] Assignee: Mita Industrial Co., Ltd., Osaka, Japan

[21] Appl. No.: 840,310

[22] Filed: Feb. 24, 1992

[30] Foreign Application Priority Data

Feb. 27, 1991 [JP] Japan ..... 3-32734
Feb. 28, 1991 [JP] Japan ..... 3-59730

[51] Int. Cl.[5] ..... B65H 3/44

[52] U.S. Cl. ..... 271/9; 271/164; 271/273

[58] Field of Search ..... 271/9, 273, 164, 162

[56] References Cited

U.S. PATENT DOCUMENTS

| | | | |
|---|---|---|---|
| 4,209,249 | 6/1980 | Clark et al. | 271/9 |
| 4,939,554 | 7/1990 | Hirabayashi et al. | 271/9 |
| 4,966,356 | 10/1990 | Ohyabu et al. | 271/9 |
| 4,970,544 | 11/1990 | Furusawa et al. . | |
| 4,985,736 | 1/1991 | Kawano et al. . | |
| 5,002,266 | 3/1991 | Kikuchi et al. | 271/9 |

FOREIGN PATENT DOCUMENTS

| | | | |
|---|---|---|---|
| 139426 | 5/1985 | European Pat. Off. . | |
| 2359081 | 12/1972 | Fed. Rep. of Germany . | |
| 94942 | 5/1986 | Japan . | |
| 295935 | 12/1986 | Japan | 271/9 |
| 280137 | 12/1987 | Japan . | |
| 33035 | 2/1990 | Japan | 271/9 |
| 163224 | 6/1990 | Japan | 271/9 |
| 163227 | 6/1990 | Japan | 271/9 |
| 95040 | 4/1991 | Japan | 271/9 |

*Primary Examiner*—Robert P. Olszewski
*Assistant Examiner*—Steven M. Reiss
*Attorney, Agent, or Firm*—Beveridge, DeGrandi Weilacher & Young

[57] ABSTRACT

An image forming apparatus having a front loading paper feeding member is described which has an improved jam removing mechanism. The apparatus includes a sheet holding section having sheet trays arranged in a vertical direction for holding copy sheets. A conveying section is included for conveying a sheet sent from one sheet tray of the sheet holding section to an image forming section. A connecting member is included in the conveying section to allow the sheet trays to be drawn out from the body of the image forming apparatus conjointly with the conveying section. Other connecting members may be included to connect the sheet trays together. Further, a door member including a sheet tray may be included in the apparatus.

17 Claims, 14 Drawing Sheets

IMAGE FORMING APPARATUS HAVING A FRONT LOADING PAPER FEEDING MEMBER WITH AN IMPROVED PAPER JAM REMOVING MECHANISM

BACKGROUND OF THE INVENTION

1. Field of the Invention

The present invention relates to an image forming apparatus such as a copying machine, a facsimile apparatus, a printer for visualizing a still image as a hard copy, and more particularly, to an image forming apparatus of a type where a paper feed cassette and a paper feed tray are attached and drawn from the front of the image forming apparatus (this type will hereinafter be referred to as "front loading").

2. Description of the Prior Art

Of various imaging technologies, the electrophotographic technology, especially the Carlson process has become an established technology in the field of the image forming technology because of its characteristics: being a dry process and having rapid processability.

For practical use, paper processing mechanism for feeding a sheet to the image forming section is an important matter of the technology. To live up to the recent rapid development of the office automation, it is an important factor to reduce the size of an image forming apparatus. To meet such a trend, the basic structure having been employed from the beginning, i.e. a structure where paper feed cassettes are arranged on the right side of the apparatus has been reconsidered, and a front loading structure has been devised where a sheet is loaded and unloaded from the front surface of the apparatus. For example, an image forming apparatus shown in FIG. 1 is one of such image forming apparatuses of the front loading structure. On the front surface of a base 101, drawer type trays 102*a* to 102*d* are provided where cassettes for sheets of various sizes (B5, A4, B4) to be used are attached. A sheet of selected size is conveyed from the tray to the upper part through a paper conveying section 103 (indicated by broken lines). And, an image is transferred to the sheet at a transferring section of the image forming apparatus provided in a copying machine body 104, and is fixed at a fusing section. Then, the sheet is fed into a copy receiving tray 108.

FIG. 2 shows a condition where a front plate 109, a side plate 106 and an original cover 111 of this image forming apparatus are opened. In this situation, the paper conveying section 103 is seen on the side portion of the image forming apparatus which is disclosed by opening the side plate 106.

Sheet jam is one of the troubles that reduce copy productivity of an image forming apparatuses. For practical use, how rapid a jam state is removed to retrieve the normal state is important to increase the reliability of the apparatus. In the apparatus of FIG. 1, since the paper conveying section 103 is disclosed as shown in FIG. 2 by opening with a pull 107 a side plate 106 pivotably attached to the base 101 on a hinge 105, when sheet jam is caused, jammed sheets can easily be cleared so that the normal state is swiftly retrieved.

On the other hand, a demand for mass copying has been increasing recently, which has made it necessary that copying machines are provided with a cassette which holds a large number of sheets. The conventional apparatus shown in FIG. 1 does not have a space for attaching a drawer type tray that holds a large number of sheets.

In a prior art shown in FIG. 3, a door 11 is provided in front of a body of an image forming apparatus and a side plate is stationarily fixed. FIG. 4 schematically shows a main portion of the copying machine of FIG. 3.

In the copying machine of FIG. 3, to remove a jam state, first, the door 11 is opened to disclose a conveying portion 13 as shown in the figure, and then a guide plate 16 is opened by operating an opening and closing handle 12 in a space 15 provided in the copying machine body to separate pairs of conveying rollers 17 provided in correspondence with the trays 10.

In this copying machine, however, the space 15 for operation (for example, a space with a width of 150 mm to 200 mm) is required inside the copying machine in order to open the guide plate 16 and to thereby separate pairs of the conveying rollers 17. As a result, the size of the apparatus cannot be reduced and moreover the jam state cannot rapidly be removed.

SUMMARY OF THE INVENTION

An object of the present invention is to provide an image forming apparatus which is provided with: sheet holding means including a plurality of sheet trays arranged in a vertical direction where a sheet is placed; image forming means; conveying means for conveying a sheet sent from one sheet tray of said sheet holding means to said image forming means; and connecting means for enabling said conveying means to be drawn out from the body of the image forming apparatus conjointly with at least one sheet tray of said sheet holding means.

According to another feature of the present invention, an image forming apparatus is provided with: a first sheet tray arranged within a body of the image forming apparatus in a front loading manner; image forming means; conveying means for conveying a sheet from said first sheet tray to said image forming means; and a door member having a second sheet tray which can hold a large number of sheets and for opening and closing said conveying means.

BRIEF DESCRIPTION OF THE DRAWINGS

This and other objects and features of this invention will become clear from the following description taken in conjunction with the preferred embodiments with reference to the accompanied drawings in which.

DESCRIPTION OF THE PREFERRED EMBODIMENT

Figure 5:
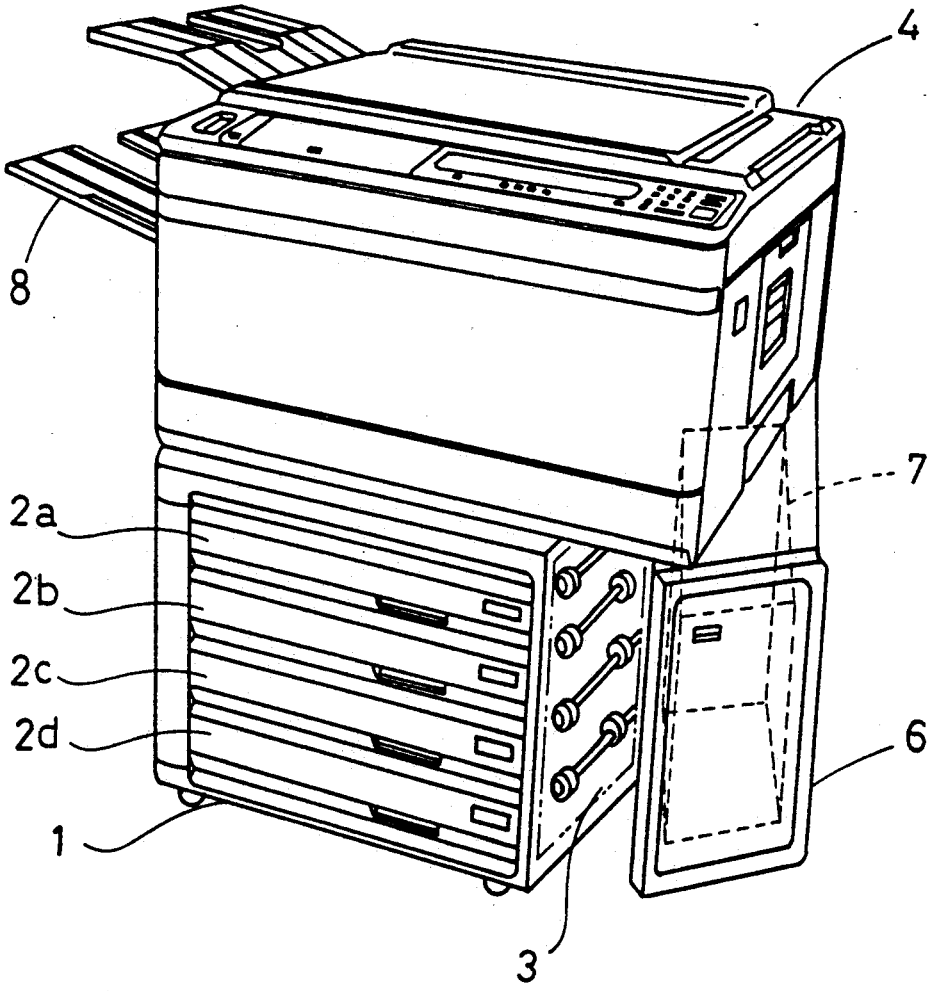
FIG. 5 is a perspective view of an image forming apparatus which is a first implementation of the present invention where a pivotable door thereof is opened.
Figure 6:
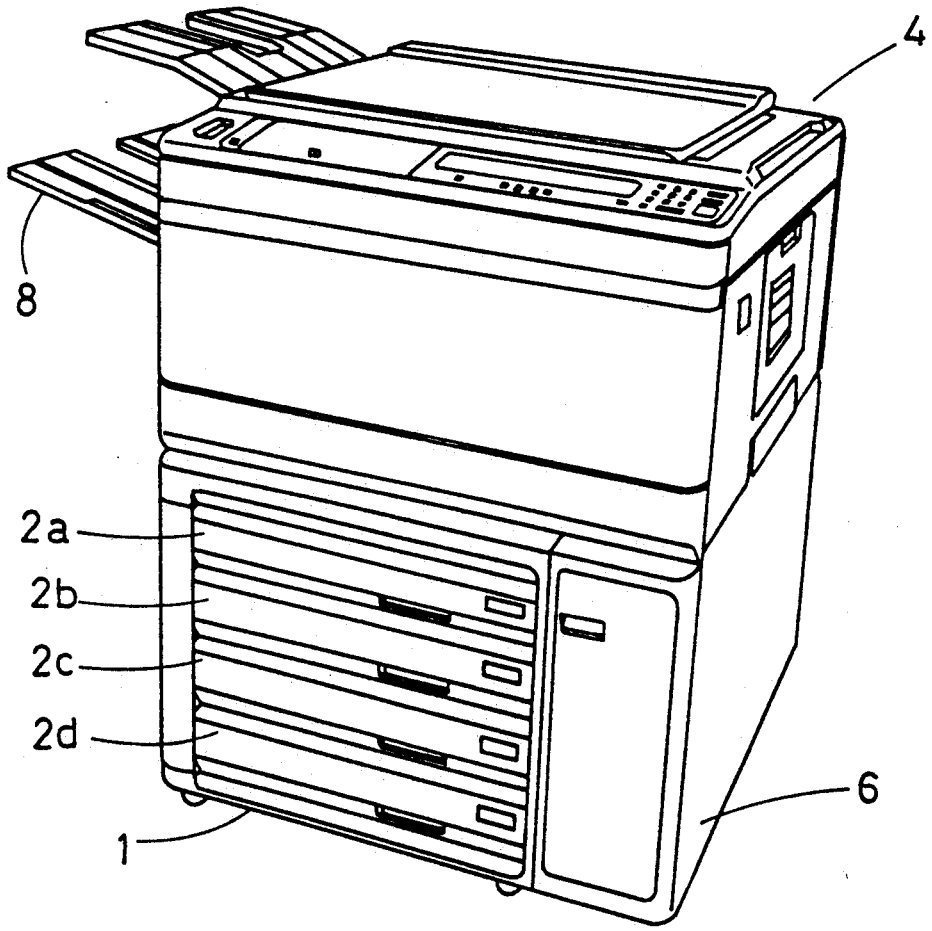
FIG. 6 is a perspective view of the image forming apparatus which is the first implementation of the present invention.

FIGS. 5 and 6 show the appearance of a first implementation of the present invention. FIG. 5 shows a state in which a pivotable door 6 provided as the door means and including a cassette 7 for holding a large number of sheets is pivoted from a base 1 so that a paper conveying section 3 is largely disclosed. The base 1 forms a part of the image forming apparatus body. On the front surface of the base 1, drawer type trays 2*a* to 2*d* are provided where cassettes for sheets of various sizes to be used are attached. The pivotable door 6 provided on the right side of the base 1 can be opened as shown in the figure by pivoting it about the rear part of the base 1. The cassette 7 is attached therein. The cassette 7 is of front loading type, and is inserted into and drawn from the front. An operation of conveying a sheet will briefly be described with reference to FIG. 6 showing a state in which the pivotable door 6 is closed. A sheet of selected size is drawn from the cassette, conveyed to the upper part through the paper conveying section 3 (see FIG. 5). And, an image is transferred onto the sheet at a transferring section of the image forming apparatus provided in a copying machine body 4, and is fixed at a fusing section thereof. Then, the sheet is fed into a copy receiving tray 8. A similar operation is performed for the cassette 7 in the pivotable door 6.

Figure 7:
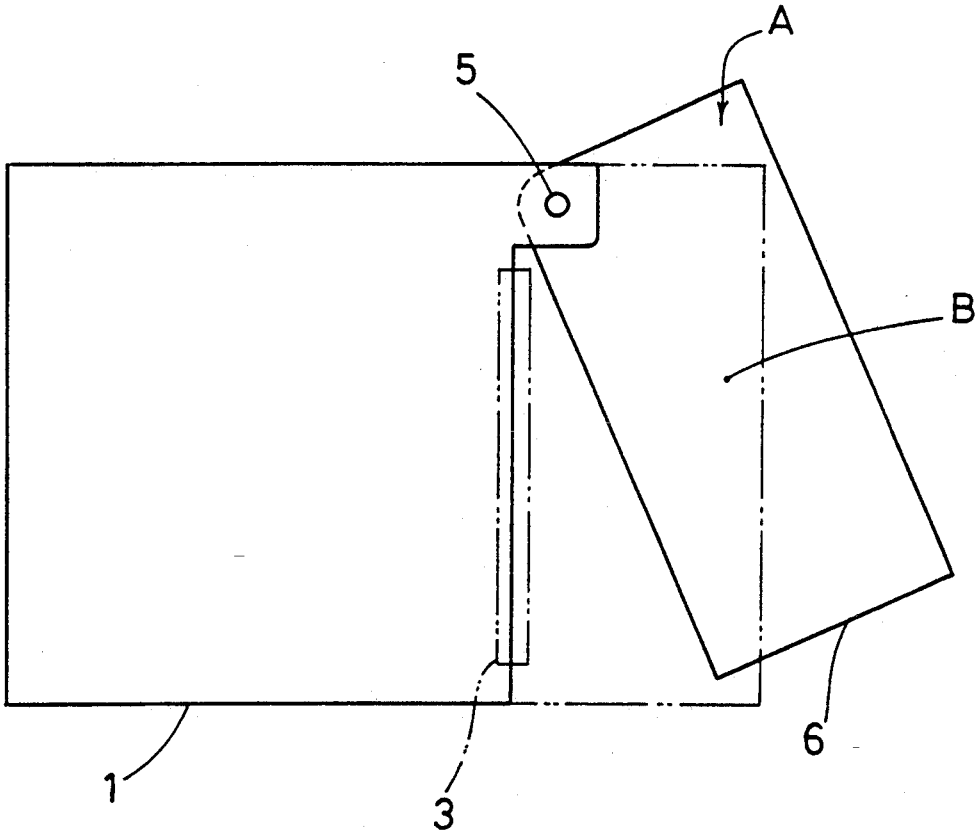
FIG. 7 is a diagram showing a relationship between a base and the pivotable door of the first implementation of the present invention.

FIG. 7 is a diagram showing a relationship between the base 1 and the pivotable door 6. The pivotable door 6 pivotally moves about a fulcrum 5 provided at the rear of the base 1. The fulcrum 5 may be provided at an arbitrary position. If it were provided in front of the position shown in the figure, the protrusion of a rear portion A of the pivotable door 6 from the rear surface of the base 1 would decrease. Also, it would be possible to design so that the portion does not protrude at all. If the fulcrum 5 were provided in the vicinity of the center B of gravity of the door 6, a smooth pivoting of the pivotable door 6 can be realized. Since the paper conveying section 3 for conveying sheets from each cassette to the transferring section is sufficiently disclosed as shown in the figure, when sheet jam is caused, it is easy to clear jammed sheets to retrieve the normal state.

Figure 8:
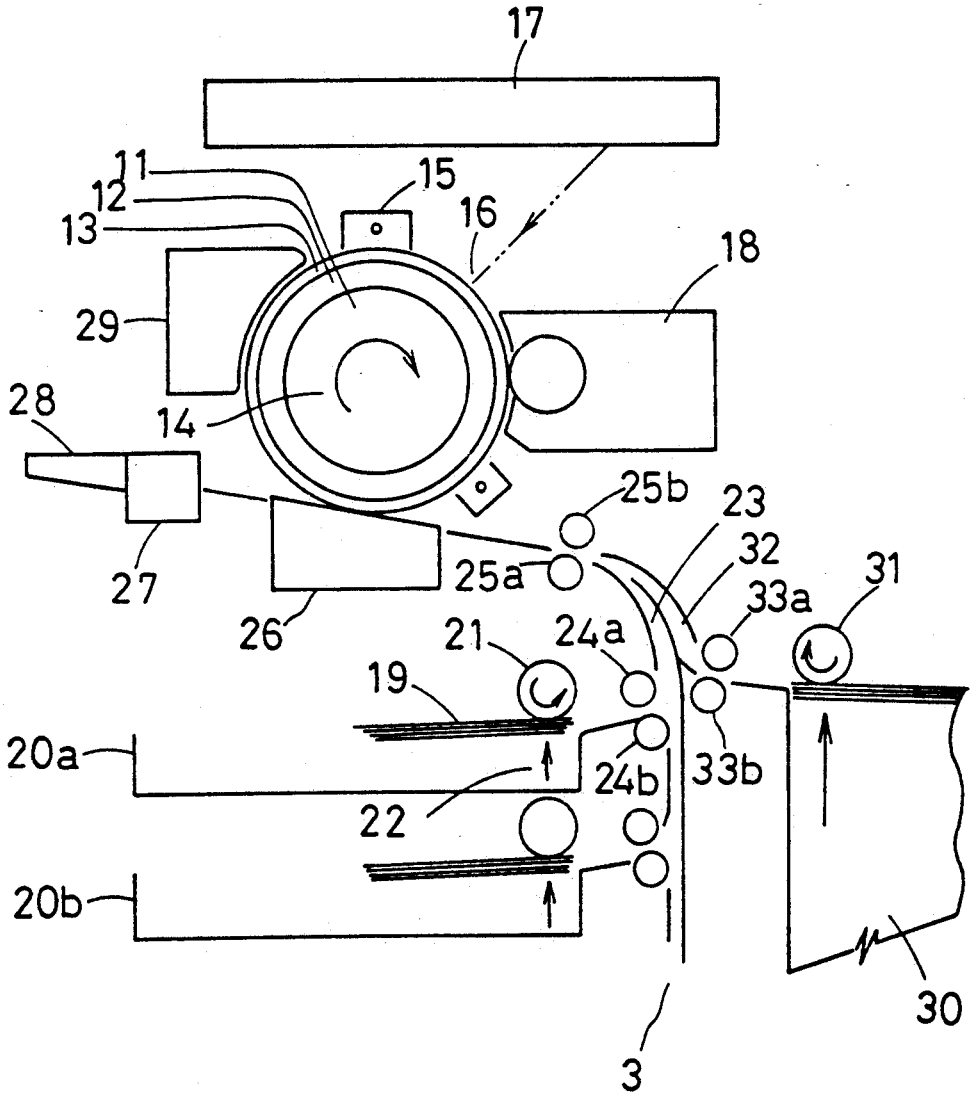
FIG. 8 is a diagram for explaining a relationship between a sheet feeding means and an image forming section of the first implementation of the present invention.

Referring to FIG. 8 which illustrates a relationship among a paper feeder, a developer and a transferror, an operation of the whole apparatus will be described. A photoreceptor drum 11 is of charge retentive type where a thin layer of, for example, zinc oxide which is an N-type semiconductor is accumulated on the surface of a cylinder 12 made of conductive metal such as aluminum and rotates in the direction of arrow 14. A charger 15 is provided with negative DC high voltage of approximately 6 kV, and charges the entire surface of the photoreceptor drum 11 to approximately −800 V by corona discharge. On the surface of the photoreceptor drum 11 charged, an image of an original from an optical reading section 17 is irradiated at an exposure section 16 to form an electrostatic latent image. The electrostatic latent image is toner-developed at a developer unit 18. A toner image of an original is thus formed on the surface of the photoreceptor drum 11.

On the other hand, a sheet 19 is drawn from, for example, a cassette 20*a* by rotation of a conveying roller 21. Since force is applied to the sheet 19 in the direction of arrow 22 by a spring or a lever, the sheet 19 is conveyed by friction with the conveying roller 21 to a first conveying path 23 through conveying roller 24*a* and 24*b*. The sheet 19 having sent to the first conveying path 23 is conveyed to a transferror 26 by guide rollers 25*a* and 25*b*. The toner image on the photoreceptor drum 11 is transferred onto the sheet 19 at the transferror 26, and is fixed at a fuser 27. Then, the sheet 19 is fed into a copy receiving tray 28. Residual toner and the electrostatic latent image on the photoreceptor drum 11 are cleaned and discharged by a discharging cleaner 29.

In case of mass copying, a sheet is drawn from a large number of sheet holding cassette 30 by conveying rollers 33*a* and 33*b*, and thereafter, is processed similarly in the above-discussed case of the cassette 20*a*.

According to the first implementation of the image forming of the present invention, as described above, a cassette for mass copying is provided, and furthermore, a jam state can rapidly be removed.

Subsequently, a second implementation of the present invention will be described with reference to FIGS. 9 to 15C.

Figure 9:
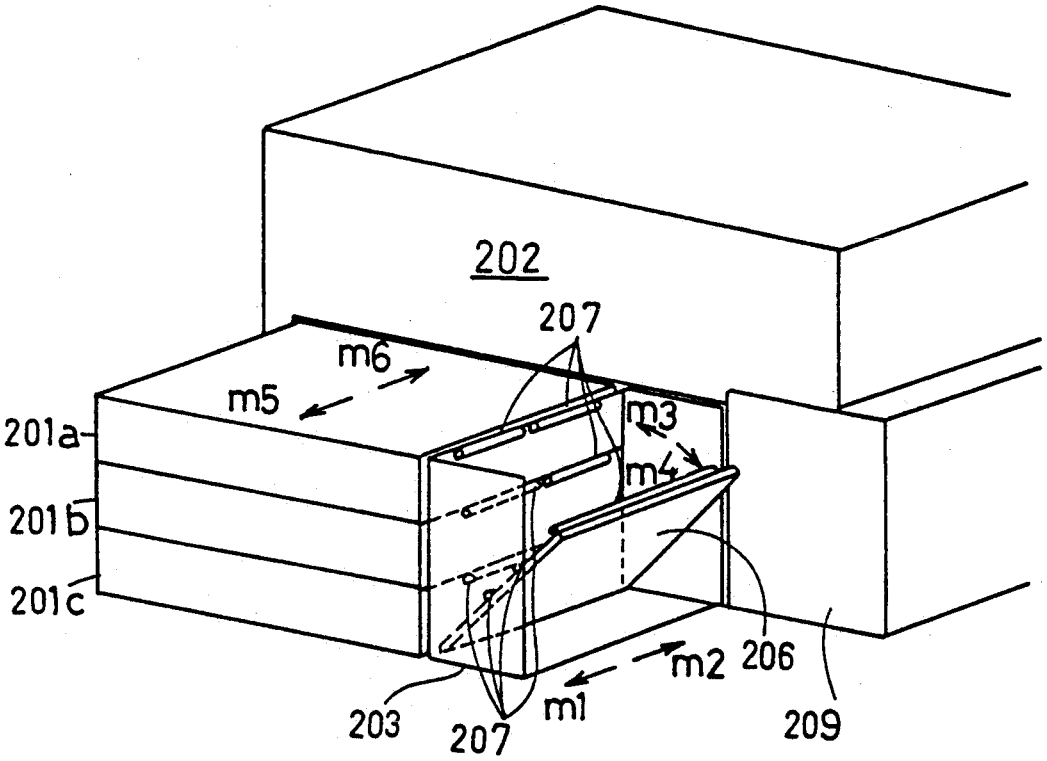
FIG. 9 is an appearance perspective view showing a schematic structure of a second implementation of the present invention.

FIG. 9 is a perspective view showing a schematic construction of a paper conveying apparatus for supplying to a transferring section sheets of paper of the copying machine. This paper conveying apparatus mainly includes trays 201*a*, 201*b* and 201*c* and a conveying section 203.

The trays 201*a* to 201*c* are of front loading type which can be inserted (in the direction of arrow m6) into and drawn (in the direction of arrow m5) out of a copying machine body 202.

A conveying section 203 is provided between a large capacity deck 209 attached to the copying machine body 202 and the trays 201*a* to 201*c*. It can be inserted (in the direction of arrow m2) into and drawn (in the direction of arrow m1) out of the copying machine body 202 similarly to the trays 201*a* to 201*c*.

Figure 15A:
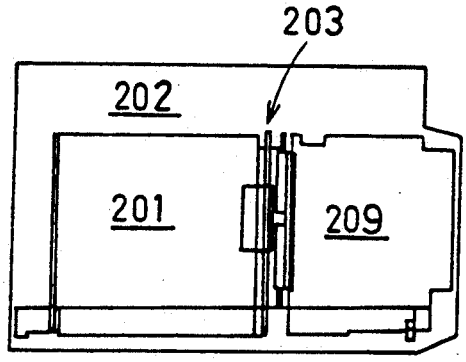
FIGS. 15A to 15C are plan views for explaining a correlation among portions constituting the second implementation of the present invention.
Figure 15B:
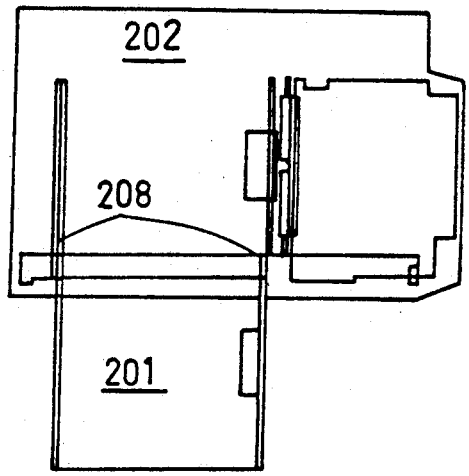
Figure 15C:
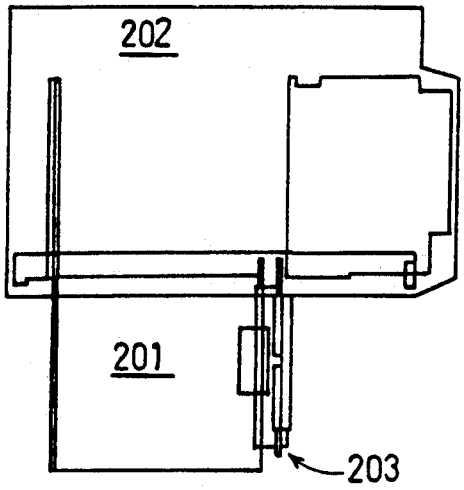

FIGS. 15A to 15C is a plan view showing the manner in which the conveying section 203 and a tray 201 (representing one of the trays 201*a* to 201*c*) are inserted into and drawn out of the copying machine body 202. In FIG. 15A, the tray 201 and conveying section 203 as well as the large capacity deck 209 are situated in the body 202, which is a stop state or a normal state. In FIG. 15B, only the tray 201 is forwardly drawn out along a rail 208. In FIG. 15C, the tray 201 and conveying section 203 are forwardly drawn out along a rail (not shown).

The trays 201*a* to 201*c* move as subsequently described conjointly with the conveying section 203 as the conveying section 203 is drawn out.

Figure 14:
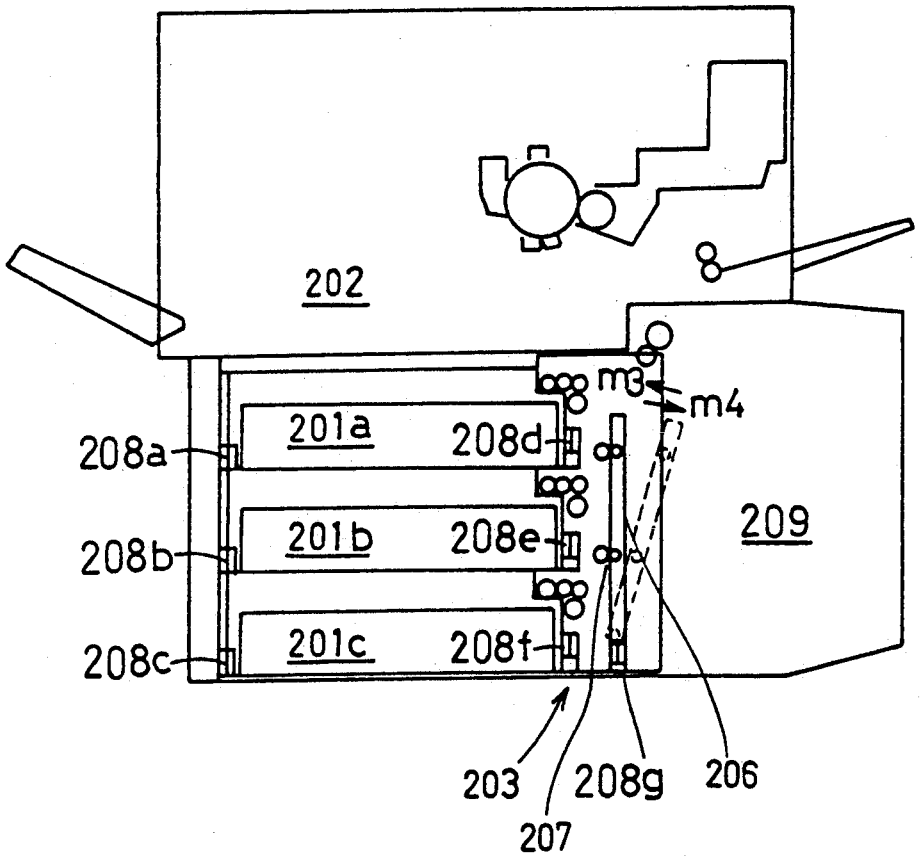
FIG. 14 is a schematic front view of an electrophotographic copying machine incorporating the second implementation of the present invention.

Specifically, the conveying section 203 and trays 201*a* to 201*c* move as shown in FIG. 14 along rails 208*a* and 208*d*, 208*b* and 208*e*, 208*c* and 208*f*, and 208*g* provided in the copying machine body 202.

Figure 1:
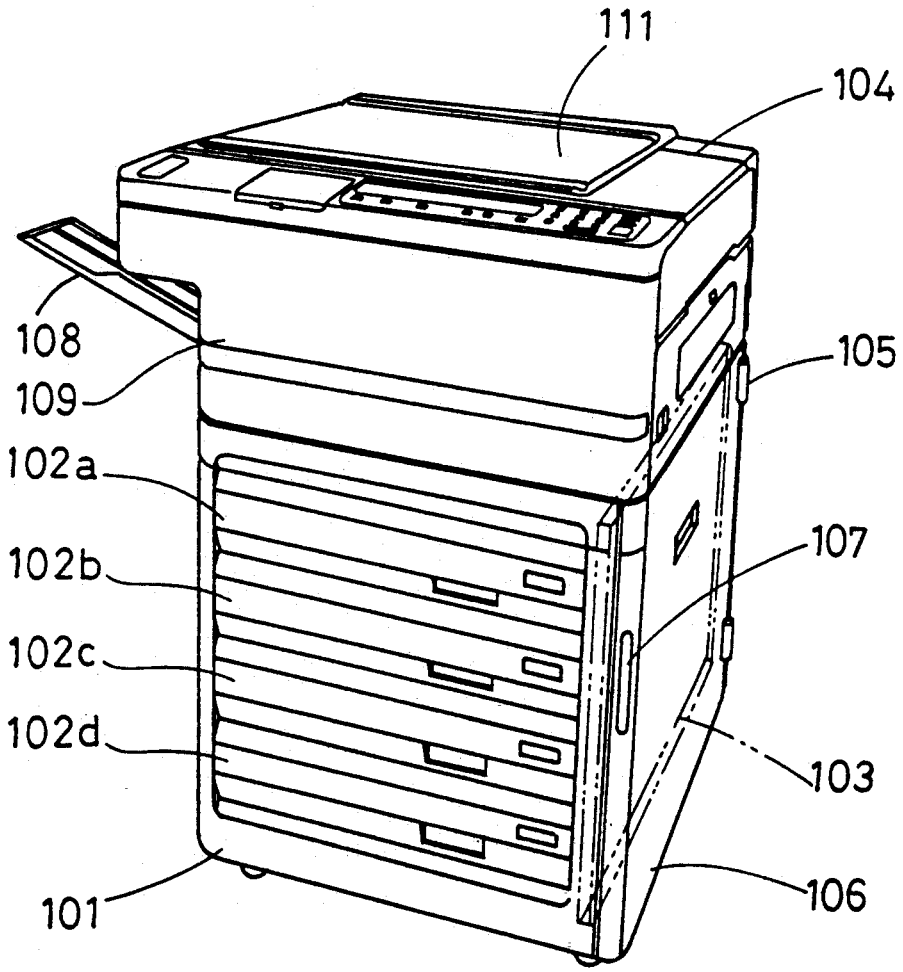
Fig. 1 Prior Art
FIG. 1 is a perspective view showing the appearance of a conventional image forming apparatus.
Figure 2:
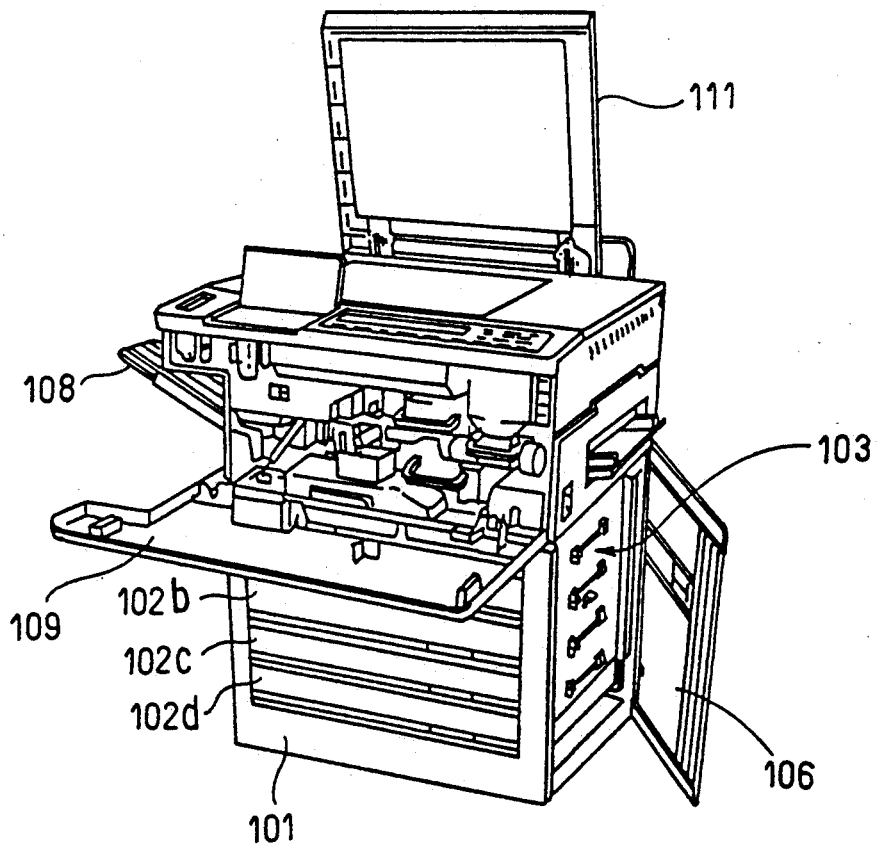
Fig. 2 Prior Art
FIG. 2 is a perspective view showing the appearance of the image forming apparatus of FIG. 1 where cover plates thereof are opened.
Figure 3:
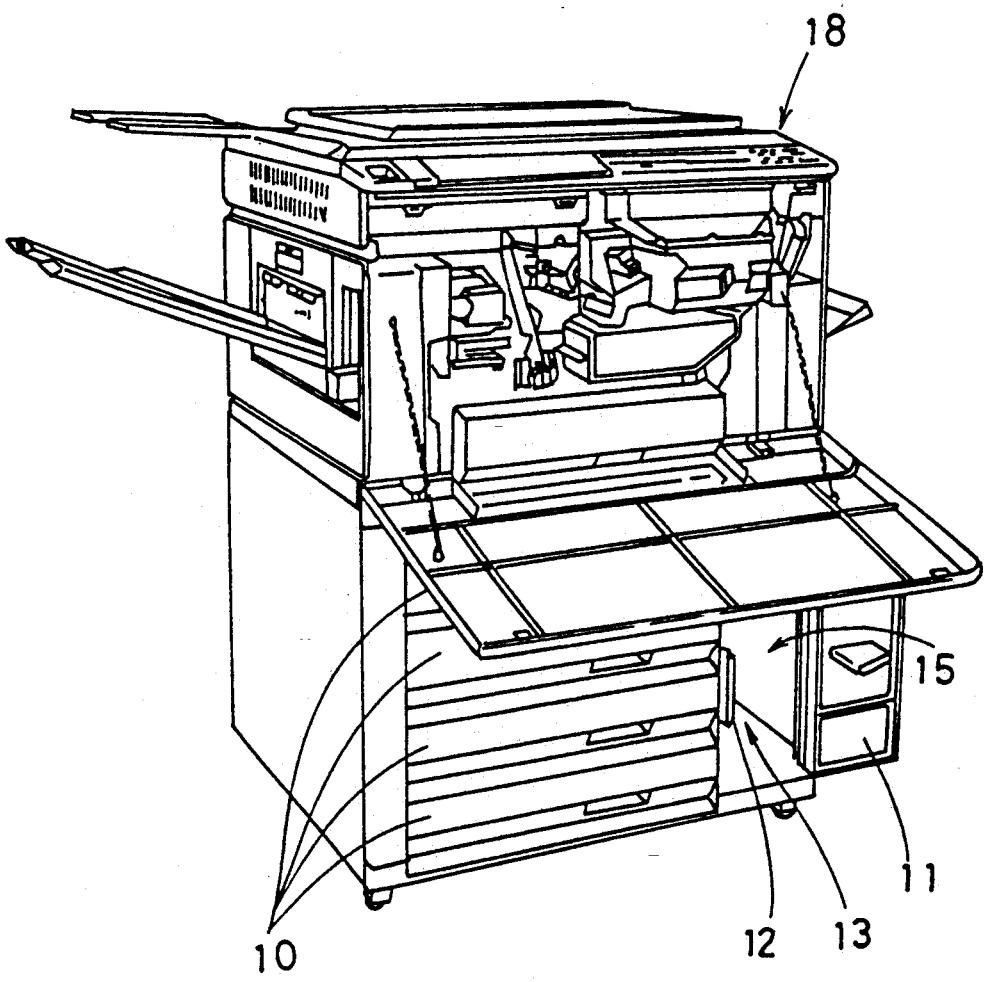
Fig. 3 Prior Art
FIG. 3 is a perspective view showing the appearance of an electrophotographic copying machine of another conventional image forming apparatus.
Figure 4:
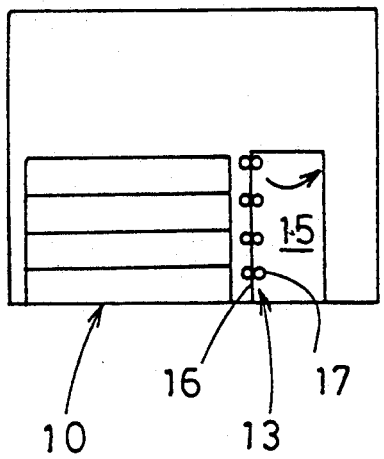
Fig. 4 Prior Art
FIG. 4 is a schematic front view of explaining the separating operations of a conveying section of the prior art shown in FIG. 3.

The conveying section 203 is provided, as shown in FIG. 9, with a guide plate 206 and pairs of conveying rollers 207 for conveying sheets to a transferring section similarly to the prior arts of FIGS. 3 to 4. The guide plate 206 is pivotally movable about the lower edge in the directions of arrows m3 and m4 (FIGS. 9 and 14).

The conveying section 203 is provided, as shown in FIG. 14, between the trays 201*a* to 201*c* and the large capacity deck 209. Hence, to open the guide plate 206 and separate pairs of conveying rollers 207, it is necessary to move the guide plate 206 (in the direction of arrow m4) after drawing out the conveying section 203. If the guide plate 206 is moved (in the direction of arrow m4) under a condition where the conveying section 203 is being drawn out, a jam state can easily be removed.

Figure 11A:
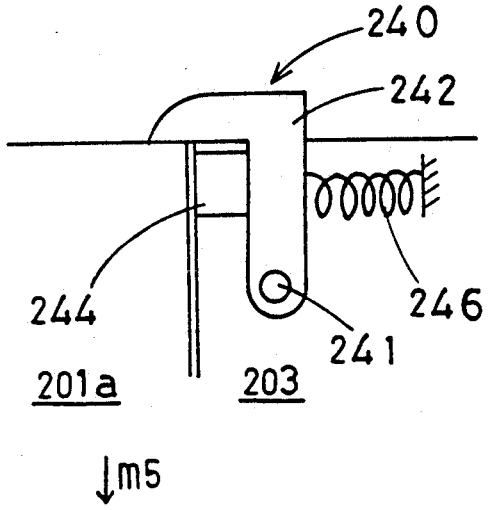
FIG. 11A is a schematic view showing an example of an engaging member employed for an implementation of the present invention.

For this implementation, an engaging means 240 and a conjoining member 250 shown in FIG. 11A are provided in order to draw the conveying section 203 out of the copying machine body 202 conjointly with all of the trays 201*a* to 201*c*.

The engaging means 240 of FIG. 11A includes a hook 242, a solenoid 244 and a spring 246, and is provided at the conveying section 203. The hook 242 is pivotable about a fulcrum 241, and under a condition where the solenoid is ON, engages as shown in the figure with a back surface of the tray 201*a* against the pull of the spring 246. Under a condition where the solenoid 244 is OFF, the hook 242 is disengaged from the tray 201 by the pull of the spring 246.

Figure 12:
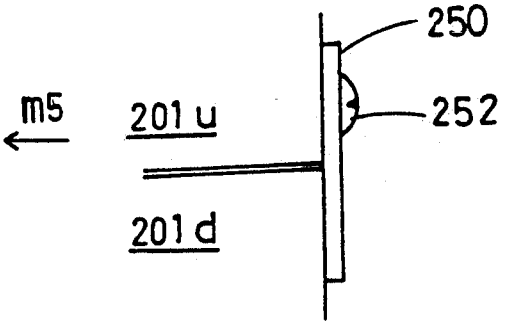
FIG. 12 is a schematic view showing an example of a conjoining member employed for the second implementation of the present invention.

The conjoining member 250 of FIG. 12 is provided in order that when a specific tray 201*u* is drawn out, a tray 201*d* arranged directly therebelow is conjointly drawn out. One end of the conjoining member 250 is fixed to the back surface of the tray 201*u* by a screw 252 so that the other end is in contact with the back surface of the tray 201*d*. The conjoining member 250 is not limited in configuration as far as it is strong enough to push out the tray 201*d*. Moreover, it may be fixed by an adhesive agent in place of the screw 252.

As the tray 201*u* is forwardly drawn out, the tray 201*d* is forwardly drawn out by the lower end of the conjoining member 50. If the tray 201*u* is, for example, the tray 201*a* of FIG. 9, the tray 201*d* is the tray 201*b*.

In this implementation, the conjoining member 250 is provided on the back surfaces of the trays 201*a* and 201*b*, while the hook 242 of the engaging means 240 engages with the back surface of the tray 201*a*. When sheet jam occurs, first, the solenoid 244 is turned on so that the engagement condition of FIG. 11 is obtained. As the conveying section 203 is drawn out, the tray 201*a* engaging with the hook 242 and the trays 201*b* and 201*c* conjoined by the conjoining members 250 of the trays 201*a* and 201*b* are drawn out all together.

Figure 11B:
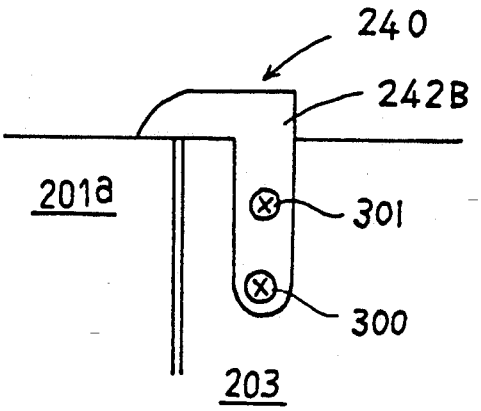
FIG. 11B is a schematic view showing an another example of the engaging member employed for the implementation of the present invention.

Instead of engaging the tray 201*a* and conveying section 203 by the driving of the hook 242 by the solenoid 244 to draw out the trays 201*a*, 201*b* and 201*c* conjointly with the drawing-out of the conveying section 203 as described above, a hook 242B fixed to the conveying section 203 through the screws 300 and 301 so as to always engage with the back surface of the tray 201*a* as shown in FIG. 11B may be used as the engaging means 240.

Moreover, if an engaging member 240 having hooks 242 which simultaneously engage with and disengage from respective trays 201*a* to 201*c* were provided to the conveying section 203, all of the trays 201*a* to 201*c* could be drawn out together with the conveying section 203 without the conjoining member 250 being provided.

Figure 13A:
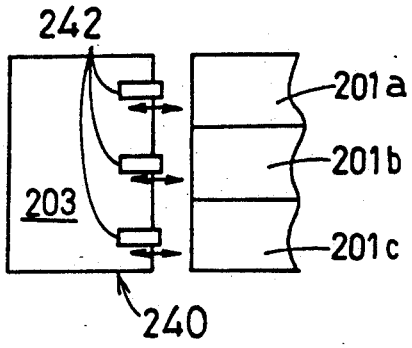
FIGS. 13A to 13E are schematic views showing a relationship between the engaging member and conjoining member, and the conveying section and trays employed for the second implementation of the present invention.
Figure 13B:
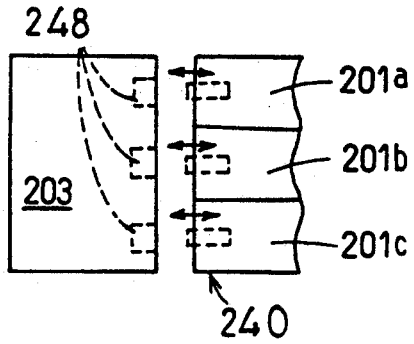
Figure 13C:
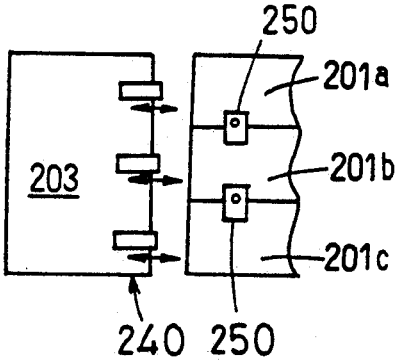
Figure 13D:
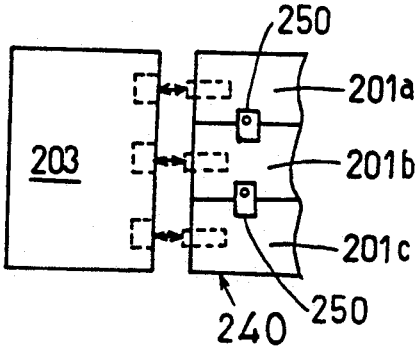
Figure 13E:
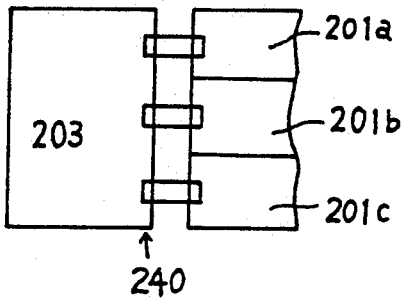

Instead of providing a plurality of hooks 242 which simultaneously engage and disengage, a plurality of fixed hooks may be provided so that the conveying section 203 always engages with the trays 201*a*, 201*b* and 201*c* as shown in FIG. 13E.

Next, an embodiment will be described where the conveying section 203 is drawn out of the copying machine body 202 conjointly with the tray 201*a*, 201*b* or 201*c* which is feeding a sheet.

Figure 10:
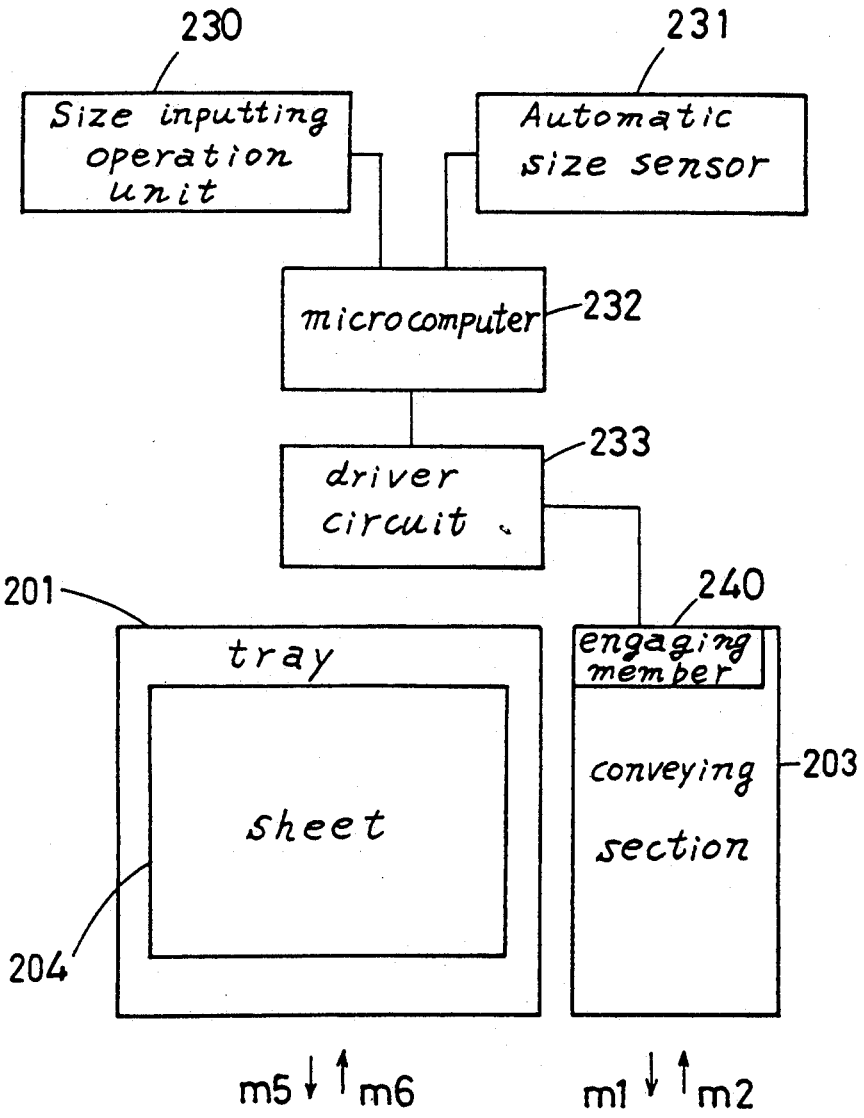
FIG. 10 is a block diagram showing a correlation among portions for controlling an operation of the second implementation of the present invention.

The block diagram of FIG. 10 shows a correlation among portions for driving the engaging member 240. As shown in the figure, a data showing the size of a sheet is transmitted from a size inputting operation unit 230 or an automatic size sensor 231 to a microcomputer 232. The size inputting operation unit 230, which is an operation panel 18 (FIG. 3), transmits a paper size data manually set by the user to the microcomputer 232. The automatic size sensor 231 is, as conventionally known, a sensor for optically scanning an original to determine a paper size from reflected light thereof, and transmits a data showing the determined size to the microcomputer 232.

The microcomputer 232 drives a forwarding roller or a multi-feed preventing roller of one of the three trays 201*a* to 201*c* in response to the input of the paper size data, and also drives through a driver circuit 233 the solenoid 244 (FIG. 11) provided to the conveying section 203 in correspondence with the selected tray 201. By the driving of the solenoid 244, the hook 242 engages with an engaging portion (i.e. the back surface of the selected tray 201). By the turning on/off of the solenoid 244, the hook 242 moves as shown by the arrows in FIG. 13A.

In this embodiment, the engaging member 240 corresponding to each of the trays 201*a*, 201*b* and 201*c* is provided as shown in FIG. 13B in order that only a tray which is feeding a sheet is drawn out conjointly with the conveying section 203. The engaging member 240 may be provided as shown in FIG. 13B to each of the trays 201*a*, 201*b* and 201*c*. In that case, it is required to provide to the conveying section 203 concave portions 248 corresponding to the trays 201*a*, 201*b* and 201*c*, respectively.

Next, an embodiment will be described where the conveying section 203 is drawn out conjointly with the tray 201*a*, 201*b* or 201*c* which is feeding a sheet and a tray arranged on a lower step of the tray which is feeding a sheet.

The microcomputer 232 is capable of driving the driver circuits 233 with respect to not only the selected tray but also the tray arranged on a lower step of the selected tray 201 based on a data showing which of the trays 201*a*, 201*b* and 201*c* is the selected tray 201 to cause the hooks 242 of the trays to engage with the engaging portions.

Therefore, in the structures shown in FIGS. 13A and 13B, only the manner of controlling the engaging member 240 is required to be changed.

Moreover, a structure where the conjoining member 250 is provided to each of the trays 201*a* and 201*b* of the embodiment of FIG. 13A, i.e. a structure shown in FIG. 13C may be employed. In this case, by moving only the engaging member 240 corresponding to a tray which is feeding a sheet, a tray arranged on a lower step of the tray which is feeding a sheet can conjointly be drawn out.

The engaging member 240 may be provided as shown in FIG. 13D to each of the trays 201*a*, 201*b* and 201*c*. In that case, it is required to provide to the conveying section 203 the concave portions 248 corresponding to trays 201*a*, 201*b* and 201*c*, respectively.

According to the implementation shown in FIGS. 9 to 15C, since a conveying portion and a paper holding member can simultaneously be drawn out from the body of the image forming apparatus, a sheet jam state caused in a portion between the paper holding member and the conveying portion can rapidly and easily be removed. Moreover, there is no need to provide an empty space as shown in FIG. 4.

Obviously, many modifications and variations of the present invention are possible in light of the above teachings. It is therefore to be understood that within the scope of the appended claims, the invention may be practiced other than as specifically described.

What is claimed is:

1. An image forming apparatus comprising:

a first sheet holding means arranged within a body of the image forming apparatus such that sheets can be loaded into the image forming apparatus from a front side thereof, wherein said first sheet holding means includes a plurality of sheet trays which are arranged in a vertical direction;

image forming means;

conveying means for conveying a sheet from said first sheet holding means to said image forming means; and a door member including a sheet tray which can hold a plurality of sheets, wherein the sheet tray included with the door member moves with the door member, wherein at least a portion of the sheet holding means is movable with respect to the image forming means and at least a portion of the conveying means, and wherein said conveying means is arranged in a vertical direction between said first sheet holding means and the sheet tray included with the door member, such that said conveying means may be moved away from the first sheet holding means when said door member is opened.

2. An image forming apparatus according to claim 1, wherein said sheet tray included with the door member is such that sheets can be loaded into said sheet tray included with the door member from the front side of the image forming apparatus.

3. An image forming apparatus according to claim 1, wherein said door member constitutes a part of a side portion of the image forming apparatus and can pivotably be opened in a lateral direction about a rear portion of the image forming apparatus.

4. An image forming apparatus comprising:

sheet holding means including a plurality of sheet trays arranged in a vertical direction in an image forming apparatus body;

image forming means;

conveying means for conveying a sheet sent from one sheet tray of said sheet holding means to said image forming means;

first connecting means for connecting the conveying means only to one sheet tray arranged at one end of the sheet holding means in order to draw out said one sheet tray from the image forming apparatus body conjointly with the conveying means when the conveying means is drawn out from the image forming apparatus body; and second connecting means for connecting said one sheet tray to another sheet tray of the sheet holding means in order to draw out said another sheet tray from the image forming apparatus body conjointly with said one sheet tray when said one sheet tray is drawn out from the image forming apparatus body;

wherein at least a portion of the sheet holding means is movable with respect to the image forming means and at least a portion of the conveying means.

5. An image forming apparatus according to claim 4, wherein said second connecting means is provided to each sheet tray of the sheet holding means except a sheet tray arranged at an opposite end of the sheet holding means, said opposite end being opposite to said one end of the sheet holding means where said first connecting means is located, wherein the second connecting means engages with a sheet tray located in a direction toward said opposite end of the sheet holding means.

6. An image forming apparatus according to claim 5, wherein said second connecting means includes a protruding portion which protrudes from the sheet tray arranged at said one end toward the sheet tray located in the direction opposite to said one end, and wherein said sheet tray located in the direction opposite to said one end includes a contact portion which is brought into contact with said protruding portion.

7. An image forming apparatus according to claim 5, wherein said first connecting means comprises engaging means which is provided to the conveying means for engaging with said one sheet tray of the sheet holding means only when the conveying means is drawn out.

8. An image forming apparatus according to claim 7, wherein said engaging means has a hook and a solenoid, and makes an engagement and separation by activating said hook, wherein the hook is activated by turning said solenoid on and off.

9. An image forming apparatus according to claim 5, wherein said first connecting means comprises engaging means which is provided to the sheet tray arranged at said one end of said sheet holding means for engaging with said conveying means only when said conveying means is drawn out.

10. An image forming apparatus according to claim 9, wherein said engaging means has a hook and a solenoid, and makes an engagement and separation by activating said hook, wherein the hook is activated by turning said solenoid on and off.

11. An image forming apparatus according to claim 4, wherein said second connecting means is a protruding portion which protrudes from said sheet tray arranged at said one end toward another sheet tray, and wherein said another sheet tray has a contact portion which is brought into contact with said protruding portion.

12. An image forming apparatus comprising:

sheet holding means including a plurality of sheet trays arranged in a vertical direction;

image forming means;

conveying means for conveying a sheet sent from one sheet tray of said sheet holding means to said image forming means;

connecting means provided with respect to each sheet tray and the conveying means, for enabling said conveying means to be drawn out from a body of the image forming apparatus conjointly with a sheet tray of said sheet holding means which is feeding a sheet;

signal producing means for producing a signal representative of the sheet tray which is feeding the sheet; and controlling means for activating the connecting means corresponding to the sheet tray which is feeding the sheet in response to an output of said signal producing means;

wherein at least a portion of the sheet holding means is movable with respect to the image forming means and at least a portion of the conveying means.

13. An image forming apparatus according to claim 12, wherein said connecting means has a hook and a solenoid, and makes an engagement and separation by activating said hook, wherein the hook is activated by turning said solenoid on and off.

14. An image forming apparatus comprising:

sheet holding means including a plurality of sheet trays arranged in a vertical direction;

image forming means;

conveying means for conveying a sheet sent from one sheet tray of said sheet holding means to said image forming means;

connecting means provided with respect to each sheet tray and the conveying means, for enabling said conveying means to be drawn out from a body of the image forming apparatus conjointly with a sheet tray of said sheet holding means which is feeding a sheet, wherein said conveying means can be drawn out from the body of the image forming apparatus through said connecting means conjointly with the sheet tray which is feeding the sheet and conjointly with a second sheet tray arranged in a direction opposite to a conveying direction of the sheet conveying means with respect to the sheet tray which is feeding a sheet;

signal producing means for producing a signal representative of the sheet tray which is feeding the sheet; and controlling means for activating the connecting means corresponding to the sheet tray which is feeding the sheet and the connecting means corresponding to the second sheet tray;.

wherein at least a portion of the sheet holding means is movable with respect to the image forming means and at least a portion of the conveying means.

15. An image forming apparatus according to claim 14, wherein said connecting means comprises engaging means which has a hook and a solenoid, and makes an engagement and separation by activating said hook, wherein said hook is activated by turning said solenoid on and off.

16. An image forming apparatus according to claim 14, wherein said connecting means is provided to said conveying means and engages with each sheet tray.

17. An image forming apparatus according to claim 14, wherein said connecting means is provided to each sheet tray and engages with said conveying means.

* * * * *